US005159156A

United States Patent [19]

Munk et al.

[11] Patent Number: 5,159,156

[45] Date of Patent: Oct. 27, 1992

[54] TERMINAL HOUSING INTEGRAL CARRIER STRIP WHICH PRODUCES NO LOOSE PIECE SLUGS

[75] Inventors: Ulrich B. Munk, Darmstadt; Michael Gerst, Worms, both of Fed. Rep. of Germany

[73] Assignee: AMP Incorporated, Harrisburg, Pa.

[21] Appl. No.: 706,839

[22] Filed: May 29, 1991

[30] Foreign Application Priority Data

Jun. 8, 1990 [GB] United Kingdom ..... 9012753

[51] Int. Cl.[5] ..... H05K 5/02

[52] U.S. Cl. ..... 174/50; 439/885; 403/12; 428/33; 428/60; 428/133; 220/23.4

[58] Field of Search ..... 174/50; 439/885; 403/12; 428/33, 60, 133, 188; 220/23.4

[56] References Cited

U.S. PATENT DOCUMENTS 3,366,265 1/1968 Hesselbarth ..... 220/23.4

3,737,366 6/1973 Mader ..... 428/33

*Primary Examiner*—Leo P. Picard

*Assistant Examiner*—David Tone

*Attorney, Agent, or Firm*—Bruce J. Wolstoncroft

[57] ABSTRACT

A plurality of housings are attached by a carrier strip which does not produce loose piece material which can damage the work station to which the housings are to be delivered. The carrier strip has carrier projections which extend from each respective housing, the carrier projections have enlarged portions provided at the free ends thereof. A recess is provided on the housing, the recess has first and second openings which cooperate with the enlarged portions of the carrier projections, such that when the enlarged portions are positioned in the first opening, the housings will be spaced from each other in a carrier strip arrangement, and when the enlarged portions are positioned in the second opening, and the carrier projections are severed from their respective housings, the carrier projections will be entirely disposed within the recesses of the housing, thereby preventing loose material from the carrier projections from interfering with the work station in which the housing is to be used.

16 Claims, 4 Drawing Sheets

TERMINAL HOUSING INTEGRAL CARRIER STRIP WHICH PRODUCES NO LOOSE PIECE SLUGS

FIELD OF THE INVENTION

The invention is directed to terminal housings which have an integral carrier strip provided thereon. The housings and the carrier strip are configured such that as a respective housing is severed from the carrier strip, a portion of the carrier strip is moved into another respective housing, thereby eliminating the need to dispose of loose piece material or slugs.

BACKGROUND OF THE INVENTION

Once a housing has been molded, terminals must be inserted therein, and the housing must be mated with other housings, etc. In some circumstances, the manipulation of loose piece terminal housings is preferred. However, in other instances, the manipulation of the loose piece terminals is not preferred, and is not advantageous. This is particularly evident in instance in which robotic equipment is used to position the terminals in the housings. In such situations, it is advantageous to deliver the individual housings to the robotic equipment in the form of a continuous strip, i.e. with the housings attached to some type of carrier strip.

The use of carrier strips has facilitated the transportation and manipulation of the housings. In fact the speed of many machines can be increased with the use of carrier strips. However, there are problems associated with carrier strips. If the carrier strip is made from a different material than the housings, the housings must be positioned on the carrier strip, thereby adding another step and increasing the cost of the housings.

On the other hand, if the carrier strip is made from the same material as the housings, such that the carrier strip can be integrally molded to the housings, the additional step and the added cost, as discussed above, are eliminated. However, the removal of the carrier strip can become a problem. As the housings are separated, the integral carrier strip which joins the housings must be removed. This is normally done through a shearing process or the like. This process creates loose piece material or slugs which must be removed from the assembly machinery. Consequently, costly removal devices must be incorporated in the machine in order to insure that the slugs are removed. This adds to the complexity of the machine, and adds to the overall cost of the parts produced. It should also be noted that although these slug removal devices are provided on the machines, it is likely that not all of the slugs will be properly removed. These slugs will remain in the machine, causing the machine to break down, thereby incurring repair and delay costs.

It would therefore be beneficial to provide a carrier strip which is integrally molded to the housing, but which does not produce such loose piece material or slugs when the housings are separated from each other. This would provide the most cost effective and efficient manner in which to deliver the housings to the machinery.

SUMMARY OF THE INVENTION

The invention is directed to a housing which is dimensioned to receive electrical terminals therein. The housing has a first end surface and an oppositely facing second end surface. At least one carrier projection extends from the first end surface in a direction away from the second end surface. The carrier projection has a free end positioned away from the first end surface. At least one recess extends from the second end surface in a direction toward the first end surface. The recess has a first opening and a second opening provided thereon.

As a first respective housing is moved into cooperation with a second respective housing, the free end of the carrier projection of the first housing will be positioned in the recess of the second housing, such that a plurality of housings will be provided in a carrier strip.

The invention is also directed to a plurality of housings which are attached by a carrier strip. The carrier strip has carrier projections which extend from each respective housing, the carrier projections have enlarged portions provided at the free ends thereof. Recesses are provided on the housings, the recesses have first and second openings which cooperate with the enlarged portions of the carrier projections, such that when the enlarged portions are positioned in the first openings, the housing will be spaced from each other in a carrier strip arrangement, and when the enlarged portions are positioned in the second openings, and the carrier projections are severed from their respective housings, the carrier projections will be entirely disposed within the recesses of the housings, thereby preventing the carrier projections from interfering with the work station in which the housings are to be used.

A method of delivering individual terminal housings to a work station is also disclosed. This method insures that the individual terminal housings will be delivered to the work station without the creation of loose material which can damage the work station. The carrier strip is advanced, such that a respective individual terminal housing is positioned proximate to the work station. The respective individual terminal housing is then severed from the carrier projections, such that the individual terminal housing is free to move relative to the carrier strip. Finally, the carrier projections are moved from a first position, in which the carrier projections extend from a second housing, to a second position, in which the carrier projections are completely maintained in the second housing.

DETAILED DESCRIPTION OF THE INVENTION

Figure 1:
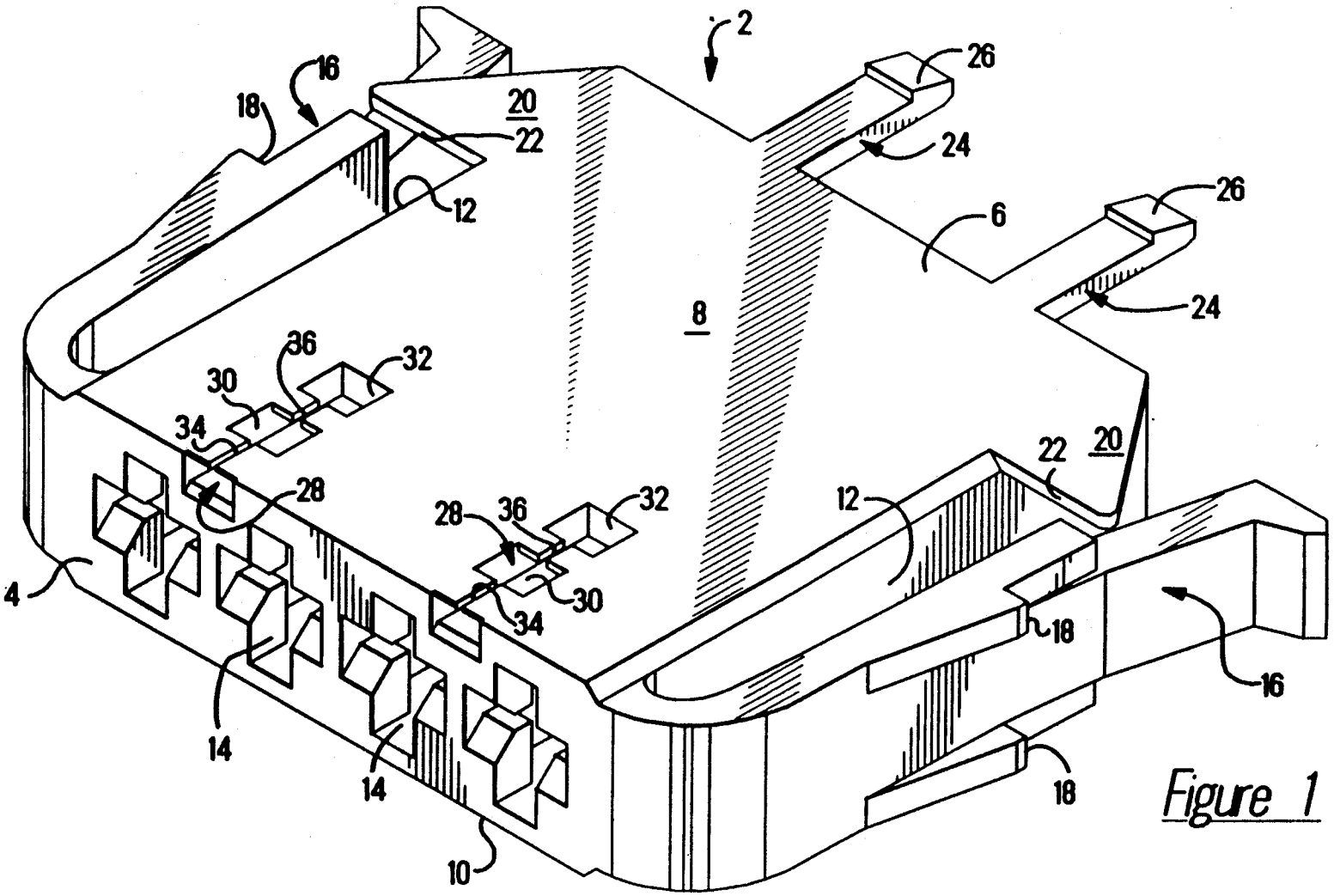
FIG. 1 is a perspective view of a single terminal housing according to the invention, prior to the removal of the carrier strip projections.

Referring to FIG. 1, connector housing 2 has a mating face 4, a terminal receiving face 6, a top surface 8, a bottom surface 10, and side surfaces 12. In the particular embodiment shown, four terminal receiving cavities 14 are provided which extend from the mating face 4 to the terminal receiving face 6. It should be noted that although four terminal receiving cavities are shown, the particular number of cavities provided in the housing can vary.

Resilient latching arms 16 extend from the side surfaces 12 of the housing 2, and are integrally attached to the side surfaces proximate the mating surface 4. The latching arms 16 are configured to provide the resilient characteristics required to allow the housing to be snapped into position on a panel or in a mating connector. Shoulders 18 are positioned on the latching arms 16 to cooperate with the mating panel or connector (not shown), to insure that the housing 2 is maintained in position. As the operation of resilient latching arms is well known in the art, a further description of the operation of the latch arm will not be provided.

Triangular projections 20 extend from the side surfaces 12 of the housing 2, and are integrally attached to the side surfaces proximate the terminal receiving surface 6. The projections 20 have shoulders 22 which are provided to act as a stop surface when the housing 2 is mated with a mating panel. In other words, as the housing 2 is inserted into an opening of the mating panel, the resilient latching arms 16 are forced to deflect inward, toward the side surfaces 12. The insertion of the housing into the opening continues until a leading surface of the mating panel engages the shoulders 22 of the projections 20. The cooperation of the leading surface of the mating panel with the shoulders 22 prevents further movement of the housing 2 in the direction of insertion. At approximately the same moment that the leading surface engages the shoulders 22 of the projections 20, the shoulders 18 of the resilient latching arms 16 are moved beyond the trailing surface of the mating panel, thereby allowing the resilient arms 16 to return toward their unstressed position. This insures that the shoulders 18 will cooperate with trailing surface. The cooperation of shoulders 22 and shoulders 18 with respective surfaces of the mating panel provide the means required to maintain the housing 2 in position relative to the mating panel. It should also be noted that the projections 20 serve to prevent wires or other objects from being tangled between the resilient latching arms 16 and the side surfaces 12.

Figure 2:
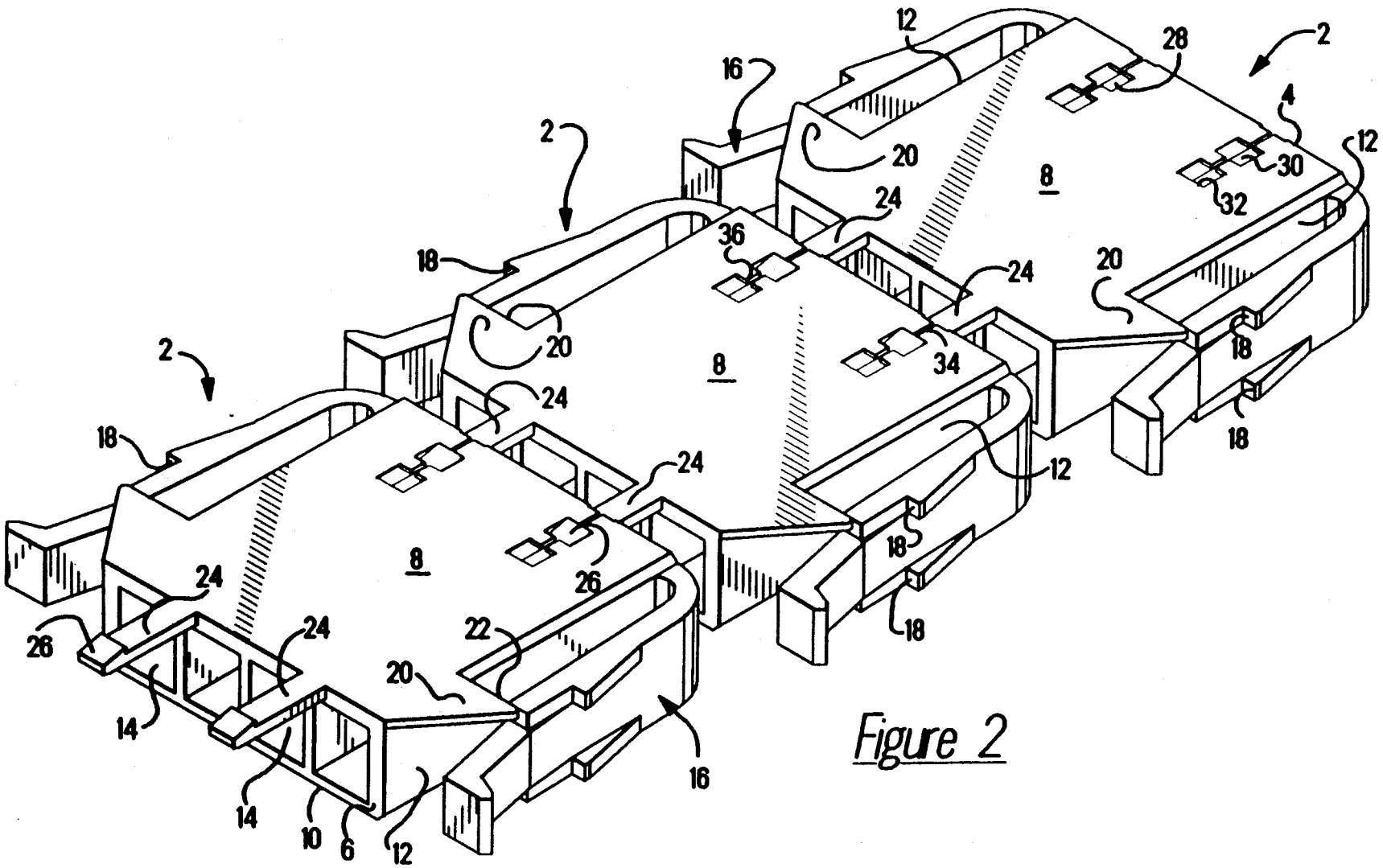
FIG. 2 is a perspective view of a plurality of the terminal housings joined together in carrier strip fashion.

Carrier projections 24 extend from the top surface 8 in a direction which is essentially parallel to the plane of the top surface. As best shown in FIG. 2, the carrier projections 24 extend from proximate the terminal receiving surface 6 in a direction away from the mating surface 4. In the embodiment shown in FIGS. 1 through 3, two carrier projections 24 are shown. Although two projections would be a common number of projections, any number of carrier projections may be provided. Each carrier projection 24 has a dimple or enlarged portion 26 provided proximate a free end thereof.

Carrier projection receiving recesses 28 extend from proximate the top surface 8 towards the bottom surface 10 of the housing 2. The recesses are provided in alignment with the carrier projections 24, such that each carrier projection 24 has a recess 28 which is provided along the same longitudinal line of the housing 2. As best shown in FIG. 2, the longitudinal alignment of the projections 24 and recesses 28 allows the housings 2 to be provided in a carrier strip, as will be more fully discussed below. It is important to note that the recesses 28 extend to the mating surface 4 of the housing 2, thereby providing an opening to the recess through the mating surface.

Each recess 28 is partially covered by the top surface 8, as best shown in FIG. 1, to form a first opening 30, a second opening 32, a slit 34, and a slit 36. As is shown in the drawings, the slit 34 extends from the mating surface 4 toward the terminal receiving surface 6. Positioned at the end of the slit 34 is the opening 30 and opening 32. Opening 30 is connected to opening 32 by slit 36. The openings and the slits extend from the top surface 8 to the recess 28.

In order to position the housings 2 in a carrier strip configuration, each individual housing 2 is molded and then moved into engagement with respective other housings. In order to provide for the carrier strip configuration, as shown in FIG. 2, the carrier projections 24 of a first housing are moved into the recesses 28 of a second housing. The alignment of the projections and recesses insures that, as the housings are moved together, the projections 24 will align with, and be positioned in the recesses 28.

As the first and the second housings 2 are moved together, the carrier projections 24 will be moved into the recesses 28 through the openings of the recesses provided in the mating surface 4 of the housing 2. The movement of the housings is continued until the dimples 26 are positioned in the first openings 30 of the housing. When this position is reached, the movement of the first and the second housings is stopped. It is important to note that the dimension of the recesses 28 and the carrier projections 24 insures that the dimples 26 will extend into the first opening 30 when the projections are properly positioned. It is because of this dimensioning that the slit 34 is provided in the top surface 8 of the housing 2. The slit 34 allows the material of the top surface to resiliently deform away from the bottom surface 10 of the housing 2 as the dimple 26 is inserted from the mating surface 4 to the first opening 30. Without the slit 34, it is conceivable that the dimple 26 would be damaged before the dimple was positioned in the first opening 30.

With the dimples 26 provided in the first openings 30, the dimples are essentially locked in position in the openings, i.e. the dimples are maintained in position until a sufficient force is applied thereto. Consequently, with the dimples 26 provided in the first openings 30, the housings 2 are provided in a continuous chain, or in a carrier strip arrangement, as shown in FIG. 2. In this continuous chain, the projections 24 and the recesses 28 act as the carrier strip.

As the retention force of the dimple 26 in the first opening 30 is not great, the housings 2 may be easily separated into any desired length by merely pulling the appropriate number of housings away from the chain. This will cause the respective dimples to be removed from the respective first openings.

Figure 3:
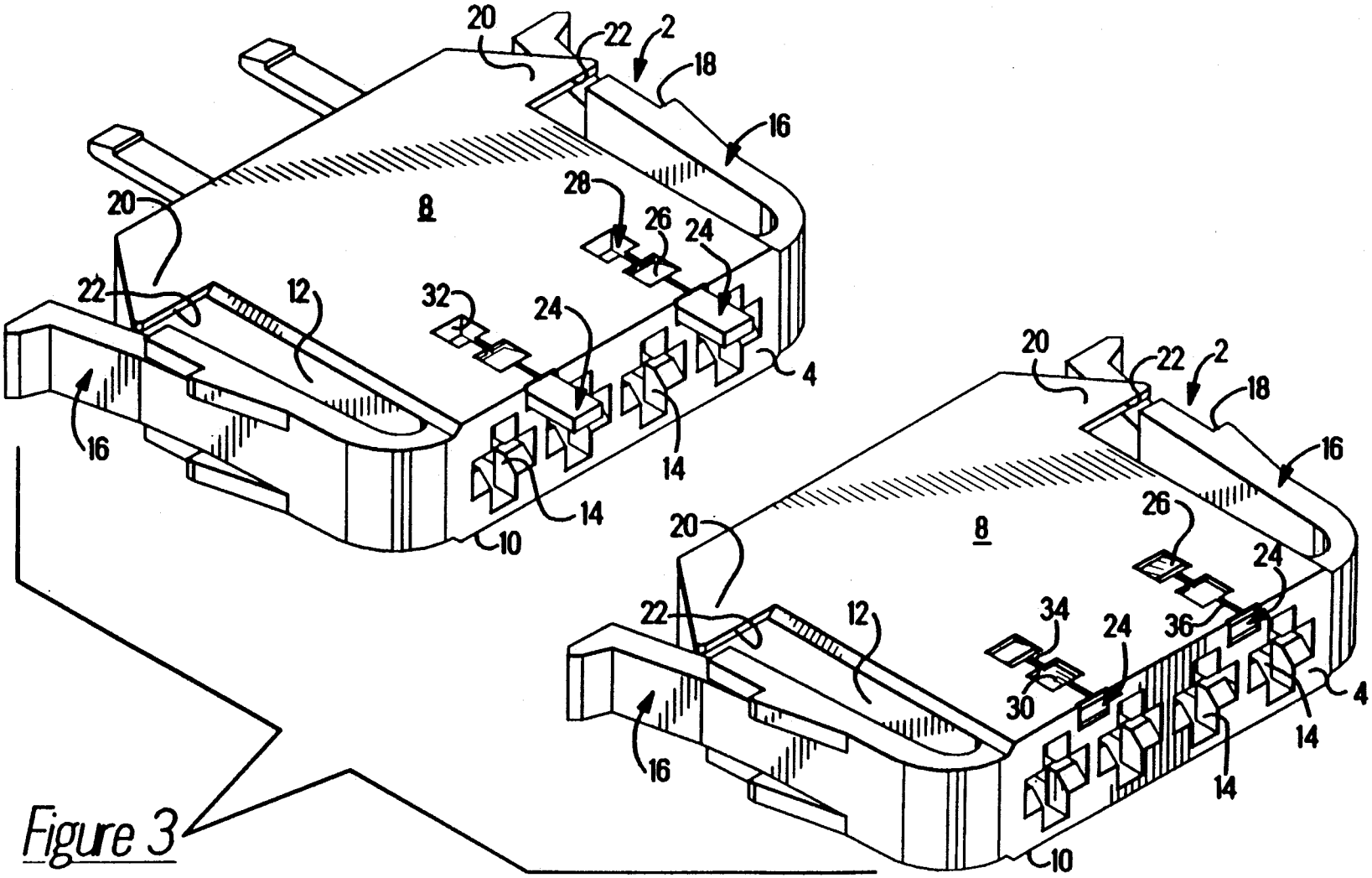
FIG. 3 is a perspective view of two terminal housings, each housing is provided to represent a different stage of removal of the housings from the carrier strip.

As a particular housing 2 is to be used, the following steps are performed, as illustrated in FIG. 3. As will be discussed, the configuration of the housing allows the housing to be removed from the carrier strip without the creation of loose piece material or slugs which can damage the termination and assembly machinery.

The first housing is advanced to a position proximate the work station. In order to allow the first housing to be advanced independent of the remaining housings, the carrier projections 24 are severed from the housing 2. As illustrated in FIG. 3, the carrier projections 24 are severed from the housing 2 at a position proximate to the terminal receiving surface 6, thereby providing the terminal receiving surface 6 with an essentially smooth surface when the carrier projections 24 are removed therefrom. The housing 2 is then advanced into position on the work station.

When the first housing 2 is severed from the carrier projections 24, the carrier projections 24 are maintained in position on the second housing, as shown in FIG. 3. The carrier projections 24 are maintained in position on the second housing by the cooperation of the dimple 26 with the first openings 30, as was previously discussed. This insures that, as the carrier projections 24 are severed from the housings 2, the carrier projections 24 will be maintained in position relative to the remaining housings. In other words, the carrier projections 24 will not be free to fall into the machinery.

After the first housing in advanced to the work station, the carrier projections 24 are moved from a first position, in which the carrier projections 24 extend from the second housing, to a second position, in which the carrier projections are moved into the second housing so that no portion of the carrier projections extend beyond the mating surface 4 of the housing 2. After the first housing is moved, a force is applied to the severed ends of the carrier projections 24. The force is applied along the longitudinal axis of the carrier projections 24, in a direction which is parallel to the longitudinal axis. This force is of sufficient magnitude to cause the dimple 26 to be moved from the first opening 30 to the second opening 32. It should be noted that as the dimple is moved from the first opening to the second opening, the slit 36 allows the material of the top surface to resiliently deform away from the bottom surface 10 of the housing 2, thereby insuring that the dimple will not be damaged as it is moved from the first opening to the second opening.

As the dimple 26 is moved from the first opening to the second opening, the carrier projections 24 are moved from the first position to the second position. The length of the carrier projections 24 is such that as the dimples 26 are provided in the second openings 32, the severed ends of the projections will be positioned within the recesses 28 of the housings. Consequently, when the carrier projections 24 are provided in the second position, the severed ends of the projections will not extend beyond the mating surfaces 4 of the housings 2. This insures that the projections will not interfere with any function of the housings into which they are positioned.

With the carrier projections properly positioned in the second position, the second housing can be advanced to the work station as needed. The entire process is repeated in the manner described above. This continues as required.

The configuration of the housing and the steps used to separate the individual housing from each other insures that respective housings will be delivered to the work station as required. In addition, no loose piece plastic parts or slugs are produced. The portions of the carrier strip which are no longer required move into the recesses of the housing, thereby insuring that no loose parts are available to fall into the machinery. As no loose parts are generated, there is no possibility of the loose parts falling into the machinery to cause the machinery to operate improperly.

Figure 4:
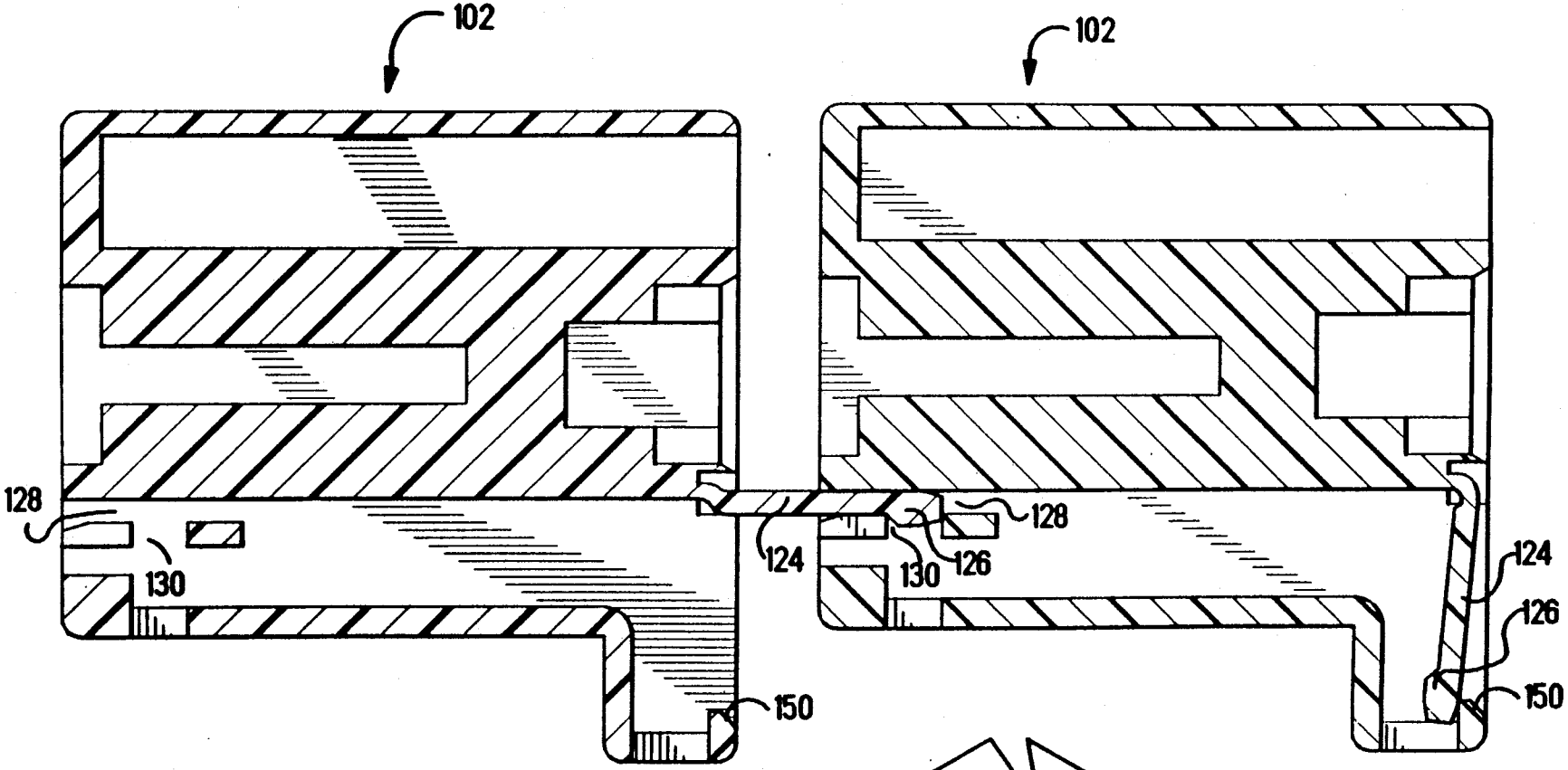
FIG. 4 is a cross-sectional view, of an alternative embodiment of the present invention, illustrating the various stages of removal of the housings from the carrier strip.

FIG. 4 shows an alternate embodiment of the invention. Although the principal of the housing 102 is identical to that of the housing 2, the carrier strip projections 124 are configured in a slightly different manner.

The housings 102 are maintained in a carrier strip fashion by the cooperation of carrier projection 124 and recess 128. As shown in FIG. 4, an enlarged end 126 of the projection 124 is provided in an opening 130 of the recess 128, positioning the projection in a first position. This provides a type of interference fit which maintains the first housing to the second housing. In order to remove the first housing from the second housing, the first housing is pulled away from the second housing, causing the projection 124 to be removed from the recess 128. The projection 124 is then bent so that the projection 124 extends in a plane which is essentially parallel to the plane of the mating face 104, thereby defining a second position of the projection. In order to retain the projection 124 in this position, the end 126 of the projection cooperates with a shoulder 150 to prevent the projection from returning to the first position.

Although the configuration of carrier projections 24 and 124 may differ, the result is the same. No loose piece plastic parts or slugs are produced. The portions of the carrier strip which are no longer required are moved into the mating face of the housing, thereby insuring that no loose parts are available to fall into the machinery. As no loose parts are generated, there is no possibility of the loose parts falling into the machinery to cause the machinery to operate improperly.

Changes in construction will occur to those skilled in the art and various apparently different modifications and embodiments may be made without departing from the scope of the invention. The matter set forth in the foregoing description and accompanying drawings is offered by way of illustration.

We claim:

1. A housing dimensioned to receive electrical terminals therein, the housing comprising:

a first end surface and an oppositely facing second end surface;

at least one carrier projection extending from the first end surface in a direction away from the second end surface, the carrier projection having a free end;

at least one recess extending from the second end surface in a direction toward the first end surface, the recess having a first opening and a second opening provided thereon;

whereby as a first respective housing is moved into cooperation with a second respective housing, the free end of the carrier projection of the first housing will be positioned in the recess of the second housing, such that a carrier strip is formed.

2. A housing as recited in claim 1 wherein the carrier projection is integrally molded to the housing, the carrier projection being severed from the housing when the housing is to be removed from the carrier strip, the free end of the carrier projection is then moved from the first opening to the second opening, the recess being dimensioned to receive the carrier projection therein when the free end of the carrier projection is moved to the second opening.

3. A housing as recited in claim 2 wherein the free end has an enlarged portion provided proximate thereto, the enlarged portion having dimensions which are slightly larger than the dimensions of the recess.

4. A housing as recited in claim 3 wherein the enlarged portion provided at the free end is a dimple.

5. A housing as recited in claim 3 wherein the recess is provided adjacent to a first side surface of the housing, the first and second openings extend from the recess through the first side surface.

6. A housing as recited in claim 5 wherein the openings are spaced from each other by a portion of the first side surface which extends over the recess, the portion of the first side surface has a slot provided therein.

7. A housing as recited in claim 1 wherein two carrier projections and two recesses are provided on the housing.

8. A housing as recited in claim 1 wherein each respective carrier projection is positioned in alignment with respective recesses.

9. A plurality of housings attached by a carrier strip, the carrier strip comprising:

carrier projections extending from each respective housing, the carrier projections having enlarged portions provided at the free ends thereof;

a recess provided on each housing, the recess having first and second openings which cooperate with the enlarged portions, such that when the enlarged portions are positioned in the first opening, the housings will be spaced from each other in a carrier strip arrangement, and when the enlarged portions are positioned in the second opening, and the carrier projections are severed from their respective housings, the carrier projections will be entirely disposed within the recesses.

10. A plurality of housings as recited in claim 9 wherein the carrier projections are integrally molded to the housings, and the recesses are dimensioned to receive the carrier projections therein when the free ends of the carrier projections are moved to the second openings.

11. A plurality of housings as recited in claim 9 wherein the enlarged portions of the free ends of the carrier projections have dimensions which are slightly larger than the dimensions of the recesses.

12. A plurality of housings as recited in claim 11 wherein the recesses are provided adjacent to first side surfaces of the housings, the first and second openings extend from the recesses through the first side surfaces.

13. A plurality of housings as recited in claim 12 wherein the first and second openings are spaced from each other by portions of the first side surfaces which extend over the recesses, the portions of the first side surfaces have slots provided therein.

14. A plurality of housings as recited in claim 9 wherein two carrier projections and two recesses are provided on each housing.

15. A plurality of housings as recited in claim 9 wherein the respective carrier projections are positioned in alignment with the respective recesses.

16. A method of delivering individual terminal housings to a work station, the method comprising the steps of:

advancing a carrier strip, such that the individual terminal housing is positioned proximate to the work station;

severing the individual terminal housing from carrier projections, such that the individual housing is free to move relative to the carrier strip;

moving the carrier projections from a first position, in which the carrier projections extend from a second housing, to a second position, in which the carrier projections are completely maintained in the second housing.

* * * * *